United States Patent [19]

Kushida

[11] 4,311,653

[45] Jan. 19, 1982

[54] FAST IDLE CARBURETOR SYSTEM

[75] Inventor: Osami Kushida, Kawagoe, Japan

[73] Assignee: Texas Instruments Incorporated, Dallas, Tex.

[21] Appl. No.: 850,166

[22] Filed: Nov. 10, 1977

[51] Int. Cl.[3] ..... F02M 1/12

[52] U.S. Cl. ..... 261/39 A; 261/39 E; 261/65; 60/527

[58] Field of Search ..... 261/39 E, 39 A, 65; 60/527

[56] References Cited

U.S. PATENT DOCUMENTS

| | | | |
|---|---|---|---|
| 2,928,233 | 3/1960 | Kimm | 60/527 |
| 3,166,894 | 1/1965 | Zmuda et al. | 60/527 |
| 3,645,509 | 2/1972 | Eckert et al. | 261/39 A |
| 3,686,857 | 8/1972 | Berg | 60/23 |
| 3,740,040 | 6/1973 | Brown et al. | 261/39 A |
| 3,782,121 | 1/1974 | Marcoux | 60/527 |
| 3,806,854 | 4/1974 | Armstrong | 261/39 E |
| 3,860,169 | 1/1975 | Norman | 60/527 |
| 4,016,722 | 4/1977 | Niederer, Sr. | 60/527 |
| 4,058,097 | 11/1977 | Silverstein et al. | 261/39 E |

*Primary Examiner*—Tim R. Miles

*Attorney, Agent, or Firm*—James P. McAndrews; John A. Haug; Melvin Sharp

[57] ABSTRACT

A carburetor system has a fast idle cam to hold the throttle plate in a fast idle position for facilitating engine operation during warm-up after starting. The cam is movable to a second position after engine warm-up to permit the throttle plate to move to its low idle position in response to a bias. A control has thermally expansible material disposed in a chamber to move a piston to move the cam to its second position with a positive force when the material is heated. Two electrical heaters are disposed in heat-transfer relation to the material. One of the heaters is connected to a power source when the engine is first started and a thermally responsive switch operable above a selected ambient temperature level connects the other heater to the power source when the ambient temperature is above that level to accelerate heating of the thermally expansible material. The material undergoes a change of physical state and a rapid expansion when heated to a temperature above the selected ambient temperature and the heaters comprise elements of a material of positive temperature coefficient of resistivity which display a sharp increase in resistivity at a temperature above the change-of-state temperature.

1 Claim, 6 Drawing Figures

FAST IDLE CARBURETOR SYSTEM

In conventional carburetors for internal combustion engines a choke plate and a throttle plate are each movably mounted in a carburetor passage to regulate the flow of an air-fuel mixture to the engine. The choke plate moves to regulate the entry of air into the passage and a thermostat metal coil is adapted to adjust the choke plate for restricting the entry of air into the passage when required to provide a richer air-fuel mixture to the engine during engine warm-up after starting and for thereafter permitting entry of a larger volume of air after engine warm-up has been completed. The throttle plate moves in response to depression of the accelerator for regulating the volume of the air-fuel mixture furnished to the engine to control engine speed but is also biased to a low idle position in the passage for normally maintaining the engine at low idle speed unless the accelerator is depressed. A fast idle cam is positioned to be engaged by a cam follower on the throttle plate shaft during engine starting for holding the throttle plate in a fast idle position against its bias during the engine warm-up, thereby to allow a greater volume of the air-fuel mixture to be furnished to the engine for facilitating engine operation during the warm-up period. The fast idle cam is typically linked to the thermostat metal coil which urges the fast idle cam from its operative position after the warm-up period is over. However the throttle plate bias is usually quite strong and the fast idle cam is frequently held in its fast idle position longer than necessary by the forceful engagement of the follower with the cam. That is, even after engine warm-up is completed, the cam tends to be held in its fast idle position by the pressure of the cam follower until the vehicle operator releases the cam follower from the cam by depressing the accelerator. This results in unnecessary fast idling with consequent loss of fuel efficiency and also results in excessively noisy engine operation during such unnecessary fast idling. This is particularly true when the ambient temperature is at the level where only a brief period of fast idle engine operation would be desirable after engine starting but where the vehicle remains stationary for passenger loading or the like for a substantial period before the vehicle operator depresses the accelerator.

It is an object of this invention to provide a novel and improved fast idle carburetor system; to provide such a system in which a fast idle cam is promptly moved from its operative position after completion of engine warm-up; to provide such a system in which the movement of the fast idle cam is accomplished more rapidly when ambient temperature is above a selected level; and to provide such a system which is of a reliable and economical construction. It is also an object of this invention to provide a novel and improved control device for use in such a fast idle carburetor system.

Other objects, advantages and details of the fast idle carburetor system and of the control device of this invention appear in the following detailed description of preferred embodiments of the invention, the detailed description referring to the drawings in which.

Figure 1:
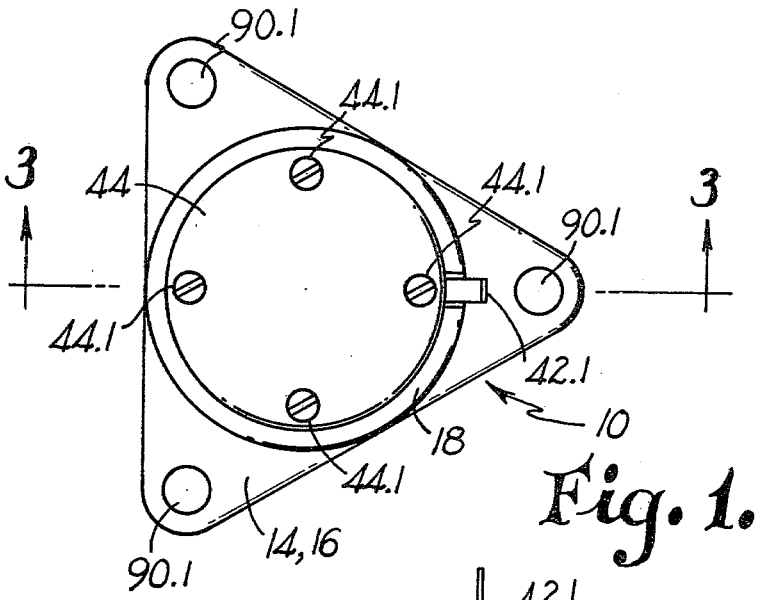
FIG. 1 is an end elevation view of the control device of this invention.
Figure 2:
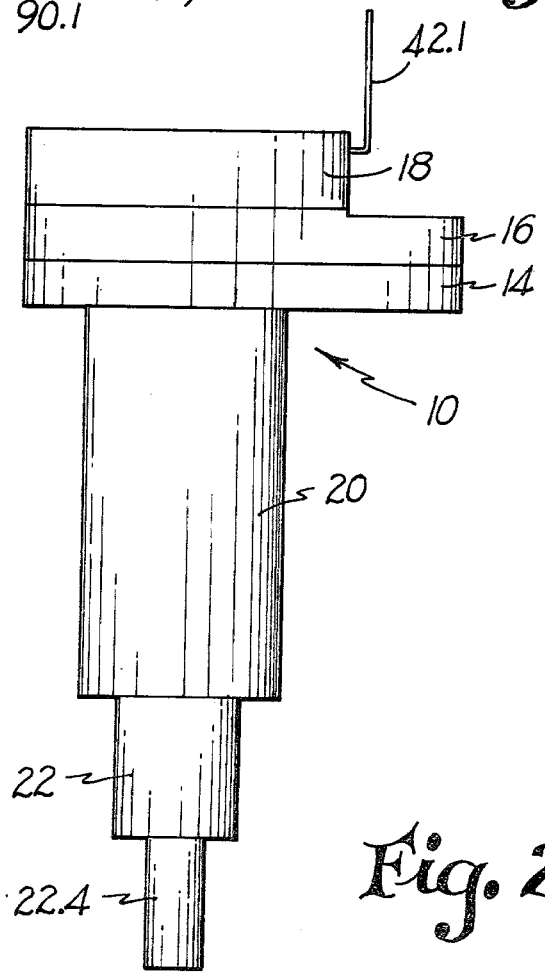
FIG. 2 is a side elevation view of the device of FIG. 1.
Figure 3:
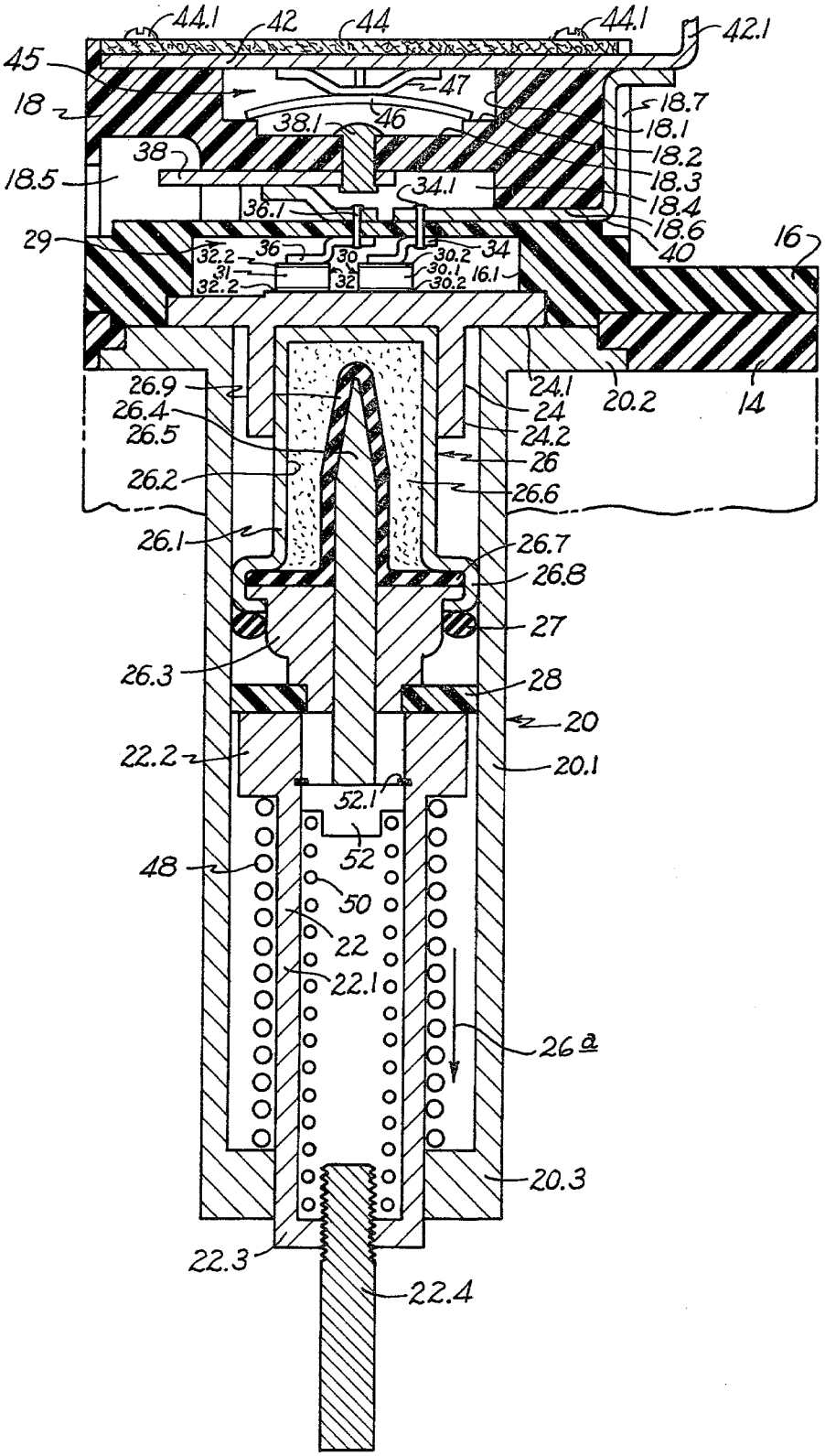
FIG. 3 is a section view to enlarged scale along line 3—3 of FIG. 1.
Figure 4:
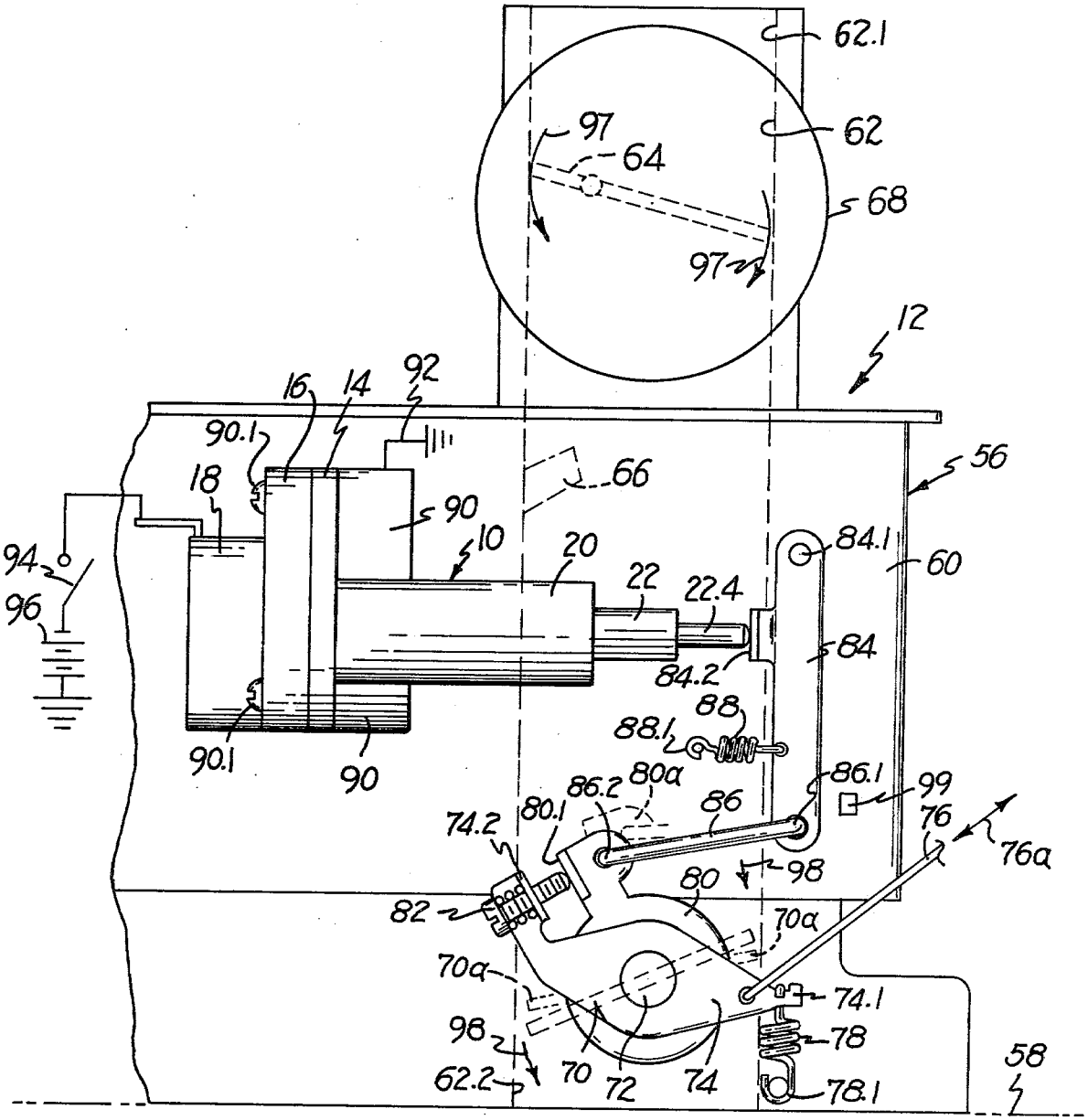
FIG. 4 is a side elevation view of the fast idle carburetor system of this invention incorporating the control device of FIG. 1.

Referring to the drawings, 10 in FIGS. 1–3 indicates the novel control device of this invention which is utilized in the fast idle carburetor system 12 of this invention as illustrated in FIG. 4. As shown, the control device 10 includes a basic housing plate 14 to which housing parts 16 and 18 are secured and from which a guide cylinder 20 extends to mount an actuator or control plunger 22. As shown particularly in FIG. 3, the guide cylinder 20 is preferably formed of a strong and rigid, electrically and thermally conductive metal material and includes a hollow cylindrical portion 20.1, a mounting flange 20.2 at one end, secured to the plate 14 by cementing or in other conventional manner, and an inturned flange or spring stop 20.3 at its distal end. The housing part 14 is formed of electrically conducting or electrically insulating material as may be preferred and is provided with means for mounting the control device 10 on a carburetor. A generally cylindrical metal cap 24, also formed of a thermally and electrically conductive metal such as brass has a flange part 24.1 abutting the flange 20.2 of the guide cylinder and has a cup part 24.2 receiving a thermally actuable wax motor or power element or the like 26 therein. The motor 26 is of any conventional design within the scope of this invention and typically includes a thermally conductive metal housing part 26.1 forming a chamber 26.2 which is open at one end, a bushing 26.3 disposed in the open chamber end, a piston 26.4 slidable in the bushing, a seal or boot 26.5 of a pliable material such as rubber of the like enclosing a portion of the piston, and a thermally expansible material 26.6 which fills the chamber 26.2 around the boot. The boot 26.5 typically has a flange part 26.7 and the housing has an inturned flange or rim edge 26.8 which secures the bushing and the boot flange to the housing 26.1 for sealing the chamber 26.2. The piston has a beveled or other force receiving surface 26.9 thereon so that thermal expansion of the material 26.6 moves the piston 26.4 down as viewed in FIG. 3 in the direction indicated by the arrow **26*a* to provide a positive and forceful control movement of the piston which is discussed in greater detail below. As the wax motor 26 can be of any conventional type such as those used in the devices of U.S. Pat. Nos. 3,686,857 or 3,782,121, other details of the wax motor are not discussed herein and it will be understood that on heating of the thermally expansible material 26.6 in a chamber 26.2, the motor is adapted to move a piston 26.4** with a positive and substantial force to provide a control movement.

As noted, the thermally expansible material 26.6 can be of conventional type and can comprise any of the various well known and conventional oils or waxes, or polyethylene materials or the like, which are adapted to display a useful degree of thermal expansion. However, in accordance with this invention, the material 26.6 preferably comprises a distilled wax or the like which is adapted to undergo a relatively abrupt change of physical state, such as a change from a solid to a liquid state, and to undergo a rapid or abrupt thermal expansion associated with that change of state when the material is heated to a selected temperature, whereby the piston 26.4 is adapted to be moved sharply and forcefully in response to such expansion at that change-of-state temperature. Typically for example the material comprises a distilled wax which remains solid at temperatures up to about 60° C. but which changes to a liquid state and undergoes approximately 10 percent volume expansion in response to a temperature rise to about 70° C. Preferably also the motor housing 26.1 has a force fit in the cup part 24.2 while the cup part has a similar force fit in the guide cylinder 20, thereby to dispose the thermally expansible material 26.6 in excellent heat-transfer relation to the cup and guide cylinder while also assuring that the cup and guide cylinder are in excellent electrically conductive engagement with each other. The motor 26 also preferably has bushings 27 and 28 arranged in engagement therewith and with the guide cylinder for axially aligning and securing the position of the motor relative to the guide cylinder.

In accordance with this invention, the housing part 16 is formed of a strong and rigid electrically insulating material such as a phenolic resin or the like and has a recess 16.1 therein. The housing part 16 is secured to the housing plate 14 by cementing or the like and an electrical heater means 29 is disposed in the housing recess 16.1 in heat-transfer relation to the cup 24, the heater means comprising a pair of electrical resistance heater elements 30 and 32. Preferably each of the heater elements has a body 30.1–32.1 of a ceramic resistance material or the like of positive temperature coefficient of resistivity and has metal contact layers 30.2–32.2 on opposite sides of the body, the elements each being disposed with a contact on one side thereof secured in electrically and thermally conductive relation to the cup flange 24.1 by soldering or by use of an electrically and thermally conductive cement (not shown). Preferably, for example, the heater elements embody a lanthanum doped barium titanate material or the like which is adapted to display a gradual increase in resistivity when the material is initially self-heated by directing electrical current through the heater body and which is adapted to display a sharp increase in resistivity when further self-heated to about 80° C. for limiting subsequent self-heating of the elements to safe levels. Electrical conductor strips 34 and 36 are secured to housing party 16 by rivets 34.1–36.1 and are engaged with the other contacts 30.2–32.2 on the opposite sides of the respective heater elements.

In accordance with this invention, a housing part 18 of generally cylindrical shape and formed of electrically insulating material is secured to the housing part 16 by cementing or in other conventional manner. The housing part 18 has a recess 18.1 in one side forming a recess shoulder 18.2 and a recess bottom 18.3 and has another recess 18.4 in the opposite side thereof. The recess 18.4 communicates through a slot recess 18.5 with a first portion of the periphery of the housing part and communicates through a slot recess 18.6 with a slot recess 18.7 on at an opposite location on the periphery of the part. An electrical conductor strip 38 is electrically connected to the strip 34 and is mounted by the rivet 38.1 which extends into the recess 18.1, the strip 38 preferably being arranged or shown to be also accessible through the slot recess 18.5. Another conductor strap 40 electrically connected to the strap 36 extends through the recesses 18.6 and 18.7 to be electrically connected to a terminal plate 42 which is disposed over the recess 18.1, the terminal plate having an insulating cover 44 thereon and being secured to the housing part 18 by screws 44.1. Preferably the terminal plate 42 has a tang 42.1 for facilitating electrical connection to the plate.

In accordance with this invention, a thermally responsive switch means 45 such as an electrically conductive, bimetallic snap-acting thermostat metal disc 46 having a dished configuration as shown in FIG. 3 is disposed within the recess 18.1 so that the disc perimeter rests on the recess shoulder 18.2, the disc being adapted to be thermally responsive to a selected operating temperature to move to an inverted dished configuration with snap action to electrically engage the central portion of the disc with the rivet 38.1. An electrically conductive spider spring 47 is also disposed in the recess 18.1 engaging the terminal plate 42 and the disc 44 and biasing the disc to engage the rivet 38.1 for electrically connecting the disc and plate in both positions of curvature of the disc. Preferably for example, the disc 46 is adapted to move to said inverted dished configuration to engage the rivet 38.1 when exposed to an ambient temperature on the order of 25° C.

In accordance with this invention, the device 10 further includes an actuator plunger 22 with comprises a hollow cylinder 22.1 open at both ends and which has an outwardly turned flange or spring stop 22.2 at one end and an inturned flange or spring stop 22.3 at its opposite end, the opposite end being threadedly engaged with an adjustable plunger tip rod 22.4. The actuator plunger 22 is disposed in the guide cylinder within a spiral compression spring 48 which engages the plunger flange 22.3 and the cylinder flange 20.3 for normally biasing the plunger to the position shown in FIG. 3 engaging the locating bushing 28. An additional spiral compression spring 50 is disposed within the actuator plunger to bear against the flange 22.3 and against the plug member 52, the plug 52 being slidable in the cylinder part of the plunger and being secured therein by the retaining ring 52.1. The spring 50 is selected to exert relatively lesser force than the spring 48 when the spring 40 is in the extended state shown in FIG. 3 but is adapted to be compressed to overcome this spring 48 for moving the plunger 22 down as viewed in FIG. 3 against the bias of the spring 48 when the plug member 52 is moved down in response to movement of the piston 26.4 in the direction indicated by the arrow 26*a*.

Figure 5:
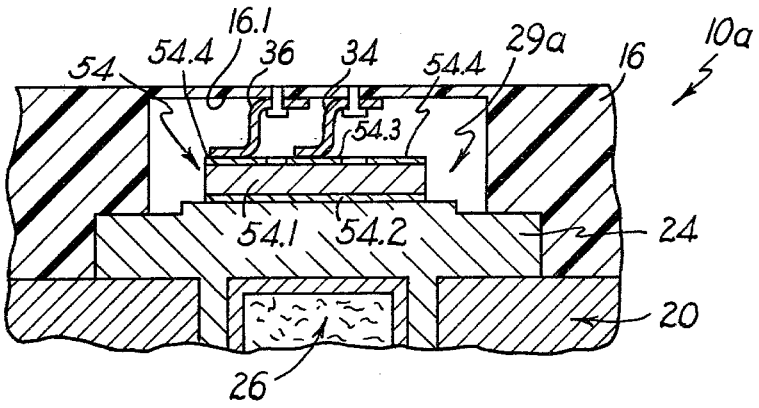
FIG. 5 is a partial section view similar to FIG. 3 illustrating an alternate embodiment of this invention.
Figure 6:
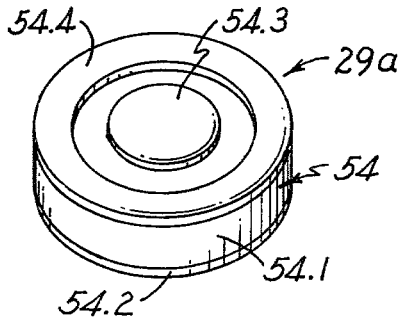
FIG. 6 is a perspective view of a heater component utilized in the device of FIG. 5.

In an alternate embodiment of this invention, as shown in FIGS. 5 and 6, a control device 10*a* incorporates heater means 29*a* comprising a multiple heater 54 having a single body 54.1 of a ceramic material of positive temperature coefficient of resistivity, the body having a single electrical contact 54.2 covering one side thereof which is secured in electrically and thermally conductive relation to the cup 24 and having a pair of electrical contacts 54.3 and 54.4 spaced relative to each other on the opposite side of the body. In the device 10*a*, the contacts 54.3 and 54.4 are respectively engaged by the strips 34 and 36. As such a multiple-heater unit is known it is not further described herein and it will be understood that when electrical current is directed through the body between contacts 54.3 and 54.2 the portion of the body between those contacts serves as one heater element while, when the current directed between the contacts 54.4 and 54.2 the portion of the body between those contacts serves as a second heater element.

As shown in FIG. 4, the control device 10 is supported on a carburetor 56 to form the novel and improved fast idle carburetor system 12 of this invention, the carburetor being mounted on the intake manifold of an internal combustion engine 58 in conventional manner. The carburetor 56 includes a metal carburetor housing 60, an air-induction passage 62 in the housing, a conventional unbalance mounted choke plate 64 movably mounted at the air-intake end 62.1 of the passage, and conventional fuel supply means 66 for introducing fuel into the passage to form an air-fuel mixture in the passage. The carburetor preferably includes choke plate control means 68 as shown in U.S. Pat. No. 3,806,854 or the like for regulating the position of the choke plate in the passage in accordance with ambient and engine temperature conditions. Alternately other conventional choke plate control means are used.

In accordance with this invention, a throttle plate 70 is movably mounted at the opposite end 62.2 of the induction passage 62 by being secured to a throttle plate shaft 72 which is journaled in the carburetor housing, the shaft being also secured to a throttle control lever 74 located outisde the housing so that movement of the control lever is effective to move the throttle plate in the passage. Conventional accelerator means diagrammatically indiacted at 76 are arranged for movement as indicated by the arrow **76*a* to adjust the throttle plate in response to control by the engine operator. In addition, a spring means 78 is secured at one end 78.1 to a boss on the housing and at its opposite end to a tang 74.1 on the throttle control lever for normally biasing the control lever for clockwise rotation as viewed in FIG. 4. A fast idle cam 80 is also disposed outside the carburetor housing and is journaled for rotation on the throttle plate shaft 72. The fast idle cam has a cam surface 80.1 disposed as shown in FIG. 4 to be engaged by an adjustable cam follower screw 82 threadedly mounted on an arm 74.2 of the control lever. A first link 84 pivotally mounted at 84.1 on the carburetor housing carries a second link 86 which is pivotally connected to the first link at 86.1 and to the fast idle cam at 86.2. A spring means 88 connected at one end 88.1 to the housing has its opposite end connected to the first link 84 to bias the first link for clockwise movement as viewed in FIG. 4**.

In accordance with this invention, the control device 10 is mounted on bosses 90 in the carburetor housing by mounting screws 90.1 so that at least the electrically conductive mounting flange 20.2 of the guide cylinder in the control device is secured in electrically conductive relation to the metal carburetor housing 60, thereby to be connected to electrical ground as is indicated at 92 in FIG. 4. This mounting of the control device also disposes the tip of the actuator plunger 22.4 in engagement with an arm 84.2 on the first link. The terminal plate 42 of the control device is electrically connected to the ignition switch 94 of the engine 58 to be electrically connected to an electrical power source such as the engine battery as indicated at 96 in FIG. 4 when the ignition switch is closed for starting of the engine 58.

In operation of the fast idle carburetor system 12, the components of the control device 10 are disposed in positions as indicated in FIG. 3 prior to starting of the engine 58. The fast idle cam 80 is also disposed with its cam surface 80.1 engaging the cam follower 82 to hold the throttle plate 70 in the fast idle position illustrated in FIG. 4. Where the ambient temperature is relatively low, below the operating temperature of the thermally responsive switch 45 of the control device, the disc 46 is in the position of curvature shown in FIG. 3. Under those temperature conditions, the choke control 68 typically disposes the choke plate 64 in the position shown in FIG. 4 partially closing the induction passage 62. Accordingly, when the ignition switch 94 is closed for starting the engine, a restricted amount of air enters the passage 62 around the choke plate as indicated by the arrow 97 to form a relative fuel rich mixture of air and fuel in the passage to assist in operation of the engine during warming-up of the engine after starting. The throttle plate is held in its fast idle position by the fast idle cam so that a sufficient volume of the air-fuel mixture is furnished to the engine as indicated by the arrow 98 for facilitating operation of the engine during the warm-up period. Closing of the ignition switch also directs electrical current through the terminal plate 42, the strip 40, and the strap 34, the heater 30, the cup 24, the guide cylinder flange 20.2 and the carburetor housing 60 to electrical ground so that the heater 30 is energized to initiate heating of the thermally expansible material 26.6.

As the engine warms up, the choke control 68 adjusts the choke plate to permit the entry of additional air into the passage 62. In accordance with this invention, the thermally expansible material 26.6 is also heated during the engine warm-up period and expands for moving the portion 26.4 in the chamber 26.2, thereby to move the plug member 52 to compress the spring 50 and to move the actuator plunger 22 down in the direction of the arrow **26*a* for compressing the spring 48. With this movement of the actuator plunger, the first link 84 is pivoted in a counterclockwise direction against the bias of the spring 88 for moving the fast idle cam 80 to the position shown in broken lines 80*a* in FIG. 4. Preferably stop 99 is provided on the carburetor housing for limiting such counterclockwise movement of the link 84, any additional movement of the piston 26.4 after the link engagement with the stop 99 being taken up by the springs 48 and 50. In this second position 80*a* of the fast idle cam, the throttle plate 70 is permitted to move to the low idle position shown by the broken lines 70*a* in FIG. 4, thereby to restrict the volume of the air-fuel mixture furnished to the engine to operate the engine at an economical and quiet, low idle speed after the engine warm-up has been completed. In the arrangement as shown, the engagement of the cam follower 82 with the fast idle cam in its second position 80*a* holds the throttle plate in its low idle position 70*a*. Alternately however, a separate low idle cam follower (not shown) can be provided on the throttle control lever to engage a separate low idle stop member for holding the throttle plate in its low idle position after the fast idle cam 80** has been moved to its second position as above described.

As will be understood, the heating capacity of the heater 30 is selected so that the fast idle cam is adapted to be moved to its second position as above described promptly after engine warm-up has been completed under the relatively low ambient temperature conditions as described. Further, where the thermally expansible material 26.6 is adapted to undergo a change of physical state from a solid to a liquid state when heated to a particular temperature, the heating capacity of the heater 30 is selected so that the material is adapted to undergo such a change of state and to rapidly expand promptly after the desired engine warm-up has been completed. In that way, the control device 10 provides a positive and forceful movement of the fast idle cam 80 to its second position promptly after the engine warm-up has been completed under low ambient temperature conditions.

On the other hand, where the engine 58 is started under temperature conditions where the ambient temperature is above the operating temperature of the thermally responsive switch 45, the disc 46 will be disposed in an inverted curvature from that shown in FIG. 3 and will accordingly be electrically engaged with the rivet 38.1 within the control device. Accordingly, on closing of the ignition switch 94 for starting the engine, electrical current will also be directed through the straps 38 and 36 and through the heater 32 to the cup 24, thereby to additionally energize the heater 32 for accelerating heating of the thermally expansible material 26.6 for moving the fast idle cam to its second position 80*a* in a shorter period of time. Accordingly, where the ambient temperature is above the selected operating temperature of the thermally responsive switch 45 and where a shorter period of fast idle operation of the engine is necessary to facilitate engine operation during engine warm-up at that ambient temperature, the control device 10 is adapted to effect more rapid movement of the fast idle cam to allow the engine to resume its low idle speed more quickly after engine starting. In either event, whether the engine is started under relatively low or relatively high ambient temperature conditions as above described, the heater elements 30 and/or 32 are adapted to display a positive temperature coefficient of resistivity for limiting self-heating of the elements to safe levels while maintaining the fast idle cam in its second position 80*a* while engine operation continues. However, when engine operation is terminated, the heaters 30 and/or 32 are deenergized for permitting cooling of the thermally expansible material 26.6, thereby to permit the springs 48, 50 and 88 to restore the piston 26.4 and the fast idle cam 80 to the position shown in FIGS. 3 and 4 respectively in preparation for a subsequent restarting of the engine.

Alternately of course, the control device 10*a* is adapted to be substituted for the control device 10 in the system 12 for achieving substantially the same mode of operation as above described. Other modifications of the described system 12 are also possible within the scope of this invention. For example, various other conventional features are also adapted to be accommodated in the carburetor 56 and various other linkage means are adapted to be arranged between the control device 10 and the fast idle cam 80 for effecting movement of the fast idle cam in response to energization of the device heaters 30 and 32.

It should be understood that this invention includes all modifications and equivalents of the disclosed embodiments of this invention which fall within the scope of the appended claims.

I claim:

1. In a carburetor having throttle plate means movable for regulating speed of operation of an internal combustion engine and means biasing the throttle plate means toward a low idle position for normally maintaining the engine at a low idle speed, fast idle means movable between a first position holding the throttle plate means in a fast idle position against said bias to maintain the engine at a relatively faster idle speed during engine warm-up after starting and a second position permitting the throttle plate means to move to said low idle position in response to said bias, chamber means, piston means movable in the chamber means for moving the fast idle means from said first to said second position thereof, a thermally expansible material in the chamber means responsive to heating for moving the piston means to move the fast idle means to the second position thereof, a source of electrical power, and electrical heater means energizeable from said power source for heating said thermally expansible material, characterized in that, said heater means comprise first and second electrical resistance heater elements disposed in heat-transfer relation to said thermally expansible material, terminal means electrically connect said first heater element to said power source on starting of the engine for heating said material, thermally responsive switch means are operable above a selected ambient temperature to electrically connect said second heater element to said power source for accelerating heating of said material when the ambient temperature is above said selected temperature, a thermally and electrically conductive metal cup receives said chamber means therein, said thermally expansible material undergoes a change of physical state and a rapid expansion associated with said change of state for promptly moving said fast idle means to the second position thereof when said material is heated to a first temperature relatively higher than said selected ambient temperature, said heater elements have a positive temperature coefficient of resistivity and are adapted to undergo a sharp increase in resistivity for limiting self-heating of the elements when heated to a temperature relatively higher than said first temperature, said heater elements are embodied in ceramic disc means of a material of positive temperature coefficient of resistivity having one side thereof secured in electrically and thermally conductive relation to said cup, and a casing has an electrically insulating portion securing said terminal means, switch means; and cup in assembled relation and has an electrically conducting portion engaging said cup to electrically connect said one side of said disc means to electrical ground.

* * * * *